United States Patent [19]

Kern et al.

[11] Patent Number: 4,647,743

[45] Date of Patent: Mar. 3, 1987

[54] CONTACT ARRANGEMENT FOR A HIGH BREAKING CAPACITY RELAY

[75] Inventors: Josef Kern; Michael Dittmann, both of Berlin, Fed. Rep. of Germany

[73] Assignee: Siemens Aktiengesellschaft, Berlin and Munich, Fed. Rep. of Germany

[21] Appl. No.: 729,224

[22] Filed: May 1, 1985

[30] Foreign Application Priority Data

May 9, 1984 [DE] Fed. Rep. of Germany ..... 3417165
Nov. 14, 1984 [DE] Fed. Rep. of Germany ... 8433394[U]

[51] Int. Cl.[4] ..... H01H 1/06
[52] U.S. Cl. ..... 200/275; 200/283
[58] Field of Search ..... 200/279, 283, 275, 284, 200/238

[56] References Cited

U.S. PATENT DOCUMENTS

| | | | |
|---|---|---|---|
| 1,560,308 | 11/1925 | Perry | 200/275 |
| 3,339,048 | 8/1967 | Haderer | 200/268 |
| 3,472,984 | 8/1967 | Cusick | 200/283 |
| 3,564,182 | 2/1971 | Habecker | 200/283 |
| 3,564,185 | 2/1971 | Bauer | 200/283 |
| 3,930,211 | 12/1975 | Belttary | 200/244 |
| 4,339,642 | 7/1982 | Seymour et al. | 200/153 G |

FOREIGN PATENT DOCUMENTS

| | | | |
|---|---|---|---|
| 8325986 | 12/1893 | Fed. Rep. of Germany . | |
| 1665958 | 4/1971 | Fed. Rep. of Germany . | |
| 8109089 | 8/1981 | Fed. Rep. of Germany . | |
| 2927879 | 9/1982 | Fed. Rep. of Germany . | |
| 1294403 | 4/1962 | France | 200/238 |

*Primary Examiner*—James E. Bryant, III
*Assistant Examiner*—Linda J. Sholl
*Attorney, Agent, or Firm*—Hill, Van Santen, Steadman & Simpson

[57] ABSTRACT

In a contact arrangement for high breaking capacity relays having a center contact spring movable between two cooperating fixed contact elements characterized by the contact spring having a contact member secured on each of the two opposite surfaces facing the fixed contact elements with one of the two contact members being of a larger size than the other contact member and the width of the contact spring to form a projection to which a flexible copper lead can be directly secured. As a result thereof, the switched current in a changeover contact can be conducted with low-loss across the center contact spring without an expensive center contact spring of a material which has a good conductivity being required.

14 Claims, 4 Drawing Figures

CONTACT ARRANGEMENT FOR A HIGH BREAKING CAPACITY RELAY

BACKGROUND OF THE INVENTION

The present invention is directed to a contact arrangement for a high breaking capacity relay wherein a movable contact spring is moved between a pair of cooperating contact elements to form a transfer arrangement. Highly conductive contact members are secured to a free end of the contact spring and are immediately connected to a lead of the current system.

Large conductor cross-sections of material having good electrical conductivity are required for switching high currents, for example, in motor vehicle relays in order to keep the voltage drop and the heating low. Since movable contact springs in such relays often do not meet these demands due to their materials and due to their relatively small cross-section, a transition has already been made for conducting the current from one terminal element directly to the contact location by a stranded copper conductor with the stranded copper conductor being directly connected to a contact member.

The contact arrangement of this type is initially described and disclosed, for example, in German Gebrauchsmuster No. 81 09 089. As disclosed, a contact member on a contact spring of a relay is conducted rivet-like in a passage through the material of the contact spring and is connected directly to the flexible cable or lead on the opposite surface.

A similar contact arrangement is disclosed in German Patent No. 29 27 879. In this arrangement, a flexible cord or lead is conducted through a passage of a contact spring and is fashioned into the contact member itself at its end. In both instances, however, the contact arrangement is only involved with one cooperating contact element so that only a normally opened or respectively normally closed relay can be formed. Since given these designs, the lead is respectively approached to that side of the contact spring lying opposite the contact member, there is no room for a second contact member which would be required for a changeover contact or for a transfer contact arrangement. Therefore, if a changeover contact having two contact members lying opposire one another on the contact spring were required for the contact arrangement, the lead must be welded onto the contact spring itself up to the present time. If one did not wish to accept high resistance in the circuit, this means that the contact spring must be manufactured of an expensive material, for example, a copper alloy having spring properties.

SUMMARY OF THE INVENTION

The present invention is directed to providing a contact arrangement for a high breaking capacity relay which can be utilized as a changeover contact or transfer contact arrangement which can handle high switching currents that are conducted lowloss across the middle contact without requiring a highly conductive and expensive spring material to be utilized for the contact spring.

This object is obtained in that the contact spring which is a center contact spring positioned between a pair of contacts carries a respective contact member on each surface which are secured to the spring with one of the two contact members having a size to project beyond the width of the contact spring and beyond the size of the contact member on the opposite surface to form a projection and that the flexible lead is welded to the projection ot this one contact member.

With the inventive design, the center contact spring with the one contact member projecting beyond the width of the spring, it is possible to directly connect the contact member with the stranded flexible lead so that the contact spring itself does not carry the switched current and can thus be manufactured of cheaper spring steel. The contact spring likewise does not offer a high resistance for the opposite, shorter or smaller contact member because the current flows from the stranded lead via the longer or larger contact member and then through a large area of the relatively thin contact spring into the other contact member.

In a further development, the resistan ce across the contact spring can also be further reduced in that at least one of the contact members has a projection or nose which extends through a hole or aperture in the center contact spring and is directly connected to the other contact member. On the basis of this design of the contact arrangement, both contact members are directly conductively connected to one another with the extended or enlarged one contact member again being welded to the flexible lead which can be, for example, a stranded conductor. The value of the resistance of the center contact spring, which is expediently composed of a spring steel which has a relatively low conductivity, will thus play no role in forming the electrical connection between the two contact members.

It will also be fundamentally possible to equip both contact members with a projection or nose wherein the two noses could be inserted into the hole of the center contact spring from opposite sides. It is simpler, however, to equip only one of the contact members with the nose which corresponds roughly to the thickness of the center contact spring. Expediently, the smaller of the two contact members is designed rivet-like and its projection or nose is inserted through the hole of the center contact spring. In this region, the two contact members are expediently directly welded to one another as well as to the center contact spring.

DESCRIPTION OF THE PREFERRED EMBODIMENTS

Figure 1:
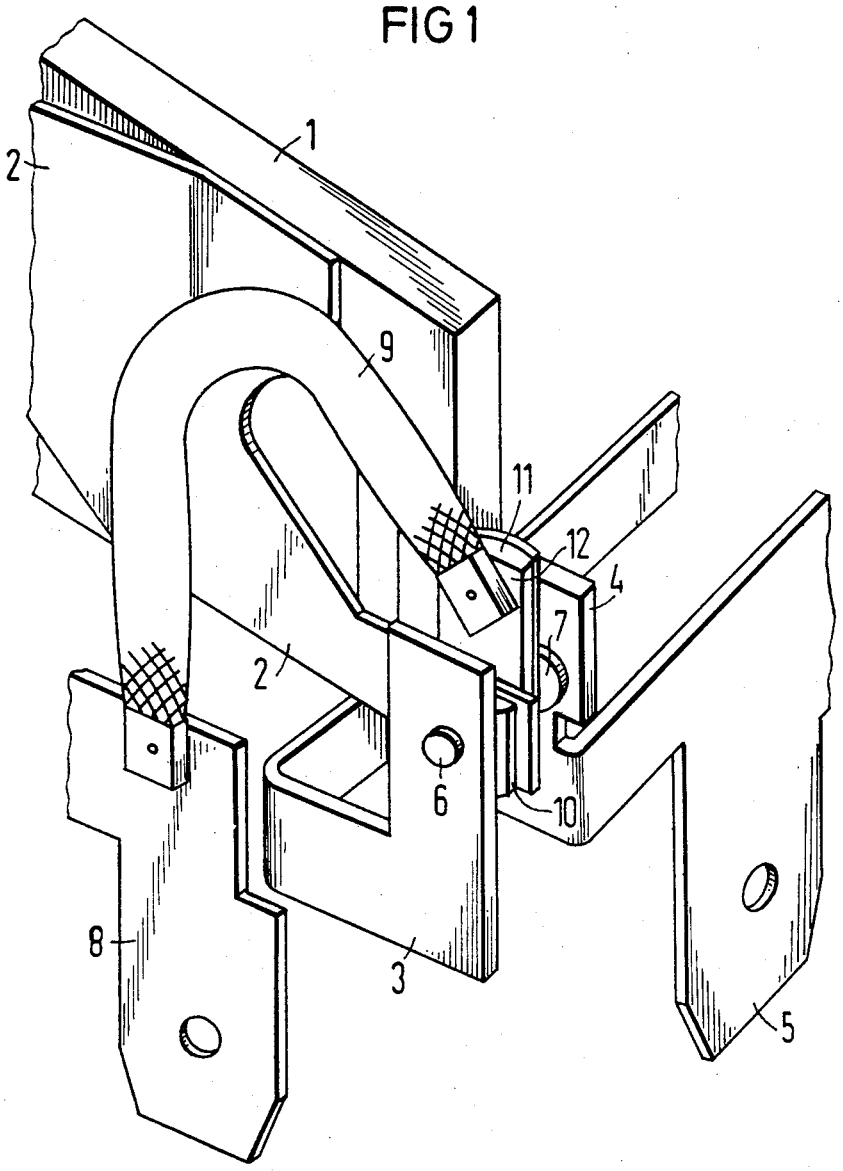
FIG. 1 is a perspective view of a contact arrangement in accordance with the present invention.
Figure 2:
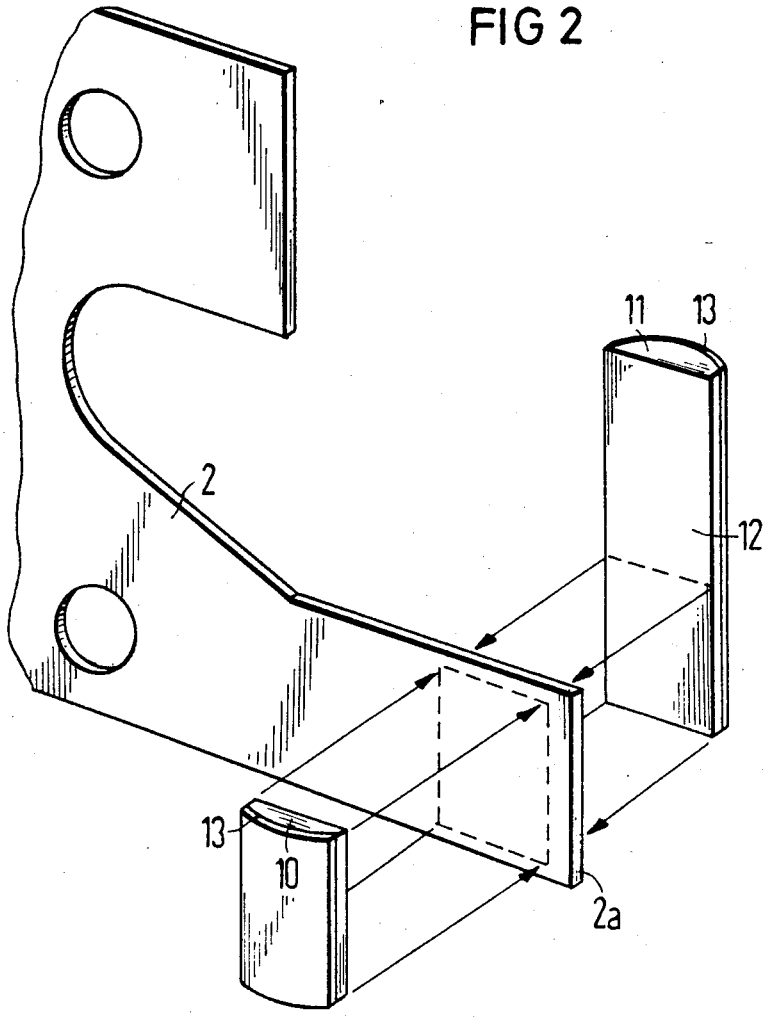
FIG. 2 is an enlarged exploded perspective view of the contact spring with the two contact members in accordance with the present invention.

The principles of the present invention are particularly useful in a contact arrangement illustrated in FIG. 1. The contact arrangement of FIG. 1 can be used with an electromagnetic system such as illustrated in German Gebrauchsmuster No. 83 25 986. As illustrated, a contact spring 2, which serves as an armature restoring spring, is secured to an armature 1 of the magnet system. The contact spring 2 has a free end 2*a* (see FIG. 2)

which is reduced in cross-section and serves as a center contact spring in an alternating contact arrangement or transfer contact arrangement having two fixed or stationary contact elements 3 and 4. The contact spring 2 is thus switchable between the two cooperating fixed contact elements 3 and 4 such that with activation of a magnetic system of the relay, the armature is moved to form a contact with one of the contact elements such as 4 and the spring force of the contact spring 2 will cause movement into contact with the other contact 3. Each of the two cooperating contact elements is anchored in a base or body (not shown) via a terminal lug, for example, a lug 5 for the contact 4. The contact 3 has a riveted or welded contact members 6 to form the contact portion for the fixed contact element whereas the contact element 4 has a contact member 7 secured thereon. An additional terminal element 8 is provided for a flexible cable or cord 9 that leads directly to an end of the contact spring 2*a* and the terminal element 8 is also anchored in the base body for the center contact spring 2.

The contact spring 2 has two contact members 10 and 11 which are welded to opposite surfaces of the end 2*a* with the contact element 10 facing the contact member 6 of the fixed contact 3 and the contact member 11 facing the contact member 7 of the fixed contact element 4. As illustrated, the contact member 11 projects beyond the width of the end 2*a* of the contact spring 2 and also beyond the width or size of the contact member 10 to form a free surface 12 on a projecting portion or projection for fastening the flexible lead 9. The switch current is thus conducted via the stranded copper flexible lead 9 from a contact member 11 directly to the terminal 8. The current can also flow from the contact member 11 to the contact member 10 through the entire area of the end 2*a* of the thin contact spring which is engaged by the contact member 10 without any significant resistance. As may be seen in detail in FIG. 2, the two contact members 10 and 11 are cut from the same strip or ribbon of material with different lengths and are welded onto opposite surfaces of the end 2*a* of the contact spring end 2. This ribbon material of the two contact members 10 and 11 consist of copper and is plated with a precious metal layer 13. As already indicated, the contact spring 2 can be formed of a cost-favorable material such as spring steel having adequate electrical conductivity and good spring properties in order to achieve the required contacting pressure between the contact members 10 and 11 and their respective contact members 6 and 7.

Figure 3:
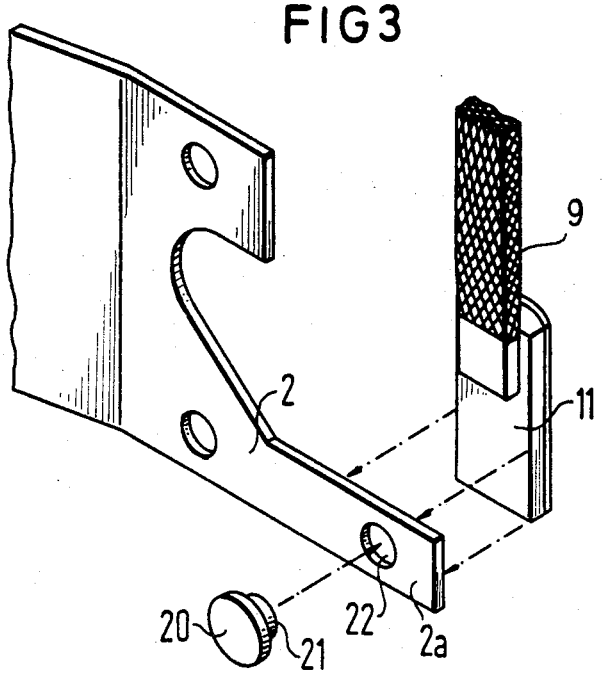
FIG. 3 is an exploded view similar to FIG. 2 of an embodiment of the contact members and spring in accordance with the present invention.
Figure 4:
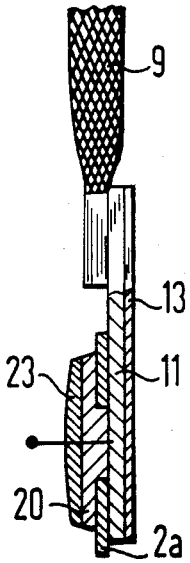
FIG. 4 is a cross-sectional view with portions in elevation for puproses of illustration of the assembled contact members on the contact spring of tne embodiment illustrated in FIG. 3.

A modified embodiment of the contact elements and the spring contact is illustrated in FIGS. 3 and 4. In this embodiment, the contact member 11 is the same as the contact member 11 in the embodiment of FIGS. 1 and 2, however, a contact member 20 replaces the contact member 10. As illustrated, the contact member 20 has a rivet-like shape and has a shank or stud 21 whose length roughly corresponds to the thickness of the contact spring 2 at the end 2*a*. The shank 21 is inserted into a hole or aperture 22 which is provided in the end 2*a* to come into contact with an inner surface of the member 11. As illustrated in FIG. 4, the two contact members 11 and 20 are in direct contact with each other in the area of the hole 22 and are welded to one another. Here, too, both contact members consist, for example, of copper or a copper alloy and are plated with a precious metal layer such as 13 or 23. However, the contact members 20 and 11 could be formed of a solid contact material, for example, of AgNi 0.15.

Although various minor modifications may be suggested by those versed in the art, it should be understood that we wish to embody within the scope of the patent granted hereon, all such modifications as reasonably and properly come within the scope of our contribution to the art.

We claim:

1. In a contact arrangement for a high breaking relay having a movable contact spring coacting with at least two fixed contact elements, said contact spring being a center contact spring having a pair of opposite surfaces and a portion extending between the two fixed contact elements, the improvements comprising said portion of the contact spring having two contact members with a contact member on each of the opposite surfaces to form a pair of contact surfaces spaced outward of the opposite surfaces of the portion of the contact spring, said contact members being electrically connected together and being of a highly-conductive material with one of the two contact members being of a size greater than the other and extending beyond an edge of the portion of the contact spring to provide a part projecting beyond said edge, and a flexible lead connected to a terminal element being secured directly to said part to electrically connect the contact members to said terminal element.

2. In a contact arrangement according to claim 1, wherein the contact spring is composed of a steel alloy having good spring properties.

3. In a contact arrangement according to claim 1, wherein the contact members are formed by a copper member plated with a precious metal.

4. In a contact arrangement according to claim 3, wherein the contact spring is composed of a steel alloy having good spring properties.

5. In a contact arrangement according to claim 1, wherein in the area of the contact members, said contact spring has an aperture, one of said contact members having a projection extending through said aperture and into contact with the other of the contact members.

6. In a contact arrangement according to claim 5, wherein the contact members are directly welded to one another.

7. In a contact arrangement according to claim 5, wherein the smaller of the two contact members is the contact member having the projection, said projection having a length corresponding to the thickness of the center contact spring.

8. In a contact arrangement according to claim 7, wherein the projection of the smaller contact member is directly welded to the larger contact member.

9. In a transfer contact arrangement having a movable contact spring positioned between a pair of spaced-apart fixed contact elements for transferring electrical current thereto, a flexible lead being connected to the movable contact spring, the improvement comprising the movable contact spring being provided with two contact members with a contact member on each of the opposite surfaces of the contact spring to form a contact surface outward of the opposite surface to face the fixed contact elements, one of the two contact members having a size greater than the other of the two contact members and greater than the width of the contact spring to form a projection extending beyond an edge of the contact spring, and said flexible lead being electrically connected directly to said projection.

10. In a transfer contact arrangement according to claim 9, wherein each of the contact members is formed of a copper material plated with a precious metal.

11. In a transfer contact arrangement according to claim 10, wherein the contact spring is composed of a steel alloy having good spring properties.

12. In a transfer contact arrangement according to claim 9, wherein the contact spring has a hole in the region of the contact members and at least one of the contact members has a projection extending through the hole and in contact with the other contact member.

13. In a transfer contact arrangement according to claim 12, wherein the smaller of the two contact members has a rivetlike shape forming the projection which extends through the hole, the length of said projection corresponding to the thickness of the center contact spring to engage the oppositely positioned contact memeber.

14. In a transfer contact arrangement according to claim 12, wherein said contact members are directly welded to one another at the hole in the contact spring.

* * * * *